US005277084A

United States Patent [19]

Weber et al.

[11] Patent Number: 5,277,084

[45] Date of Patent: Jan. 11, 1994

[54] STUD DRIVER AND REMOVER FOR LARGE DIAMETER STUDS

[75] Inventors: Edward J. Weber, Girard; Jerry L. Rounds, Erie, both of Pa.

[73] Assignee: Titan Tool Company, Fairview, Pa.

[21] Appl. No.: 966,324

[22] Filed: Oct. 26, 1992

[51] Int. Cl.[5] ..... B25B 13/50

[52] U.S. Cl. ..... 81/53.2; 279/75

[58] Field of Search ..... 81/52, 532; 279/55, 279/74, 75

[56] References Cited

U.S. PATENT DOCUMENTS

| | | |
|---|---|---|
| 595,363 | 12/1897 | Bartlett . |
| 893,958 | 7/1908 | Weaver . |
| 1,068,263 | 7/1913 | Monaghan . |
| 1,162,197 | 11/1915 | Wahlstrom . |
| 1,594,515 | 1/1926 | Bruhn . |
| 1,898,726 | 6/1932 | Hess . |
| 2,063,344 | 3/1935 | Schneider . |
| 2,069,527 | 2/1937 | Kirkland . |
| 2,105,788 | 1/1938 | Hess . |
| 2,220,654 | 11/1940 | Kirkland . |
| 2,408,335 | 9/1946 | Oliver et al. . |
| 2,613,942 | 8/1947 | Saunders . |
| 3,889,557 | 6/1975 | Young . |
| 4,611,513 | 9/1986 | Young et al. . |
| 4,676,125 | 6/1987 | Ardelean . |
| 4,724,730 | 2/1988 | Mader et al. . |
| 4,932,292 | 6/1990 | Merrick . |
| 5,152,195 | 10/1992 | Merrick . |

FOREIGN PATENT DOCUMENTS

| | | |
|---|---|---|
| 3245896 | 10/1983 | Fed. Rep. of Germany . |
| 572552 | 10/1945 | United Kingdom . |

OTHER PUBLICATIONS

Titan Tool, Roll-Grip Stud Driver and Remover (Pamphlet).

*Primary Examiner*—James G. Smith

*Attorney, Agent, or Firm*—Oliff & Berridge

[57] ABSTRACT

A stud driver and remover for large diameter studs includes an improved construction that enables the stud driver and remover to quickly remove large diameter studs that previously had to be removed usually by drilling. The improved stud driver and remover for large diameter studs includes five drive rolls, and increased ratio between the cross-sectional areas of the stud and the drive rolls. The stud driver and remover also includes an increased roll length and decreased included angle which allows the roll to penetrate more deeply into the stud. The cooperation between the cam and the core is modified to accept an increased variance in stud size.

18 Claims, 4 Drawing Sheets

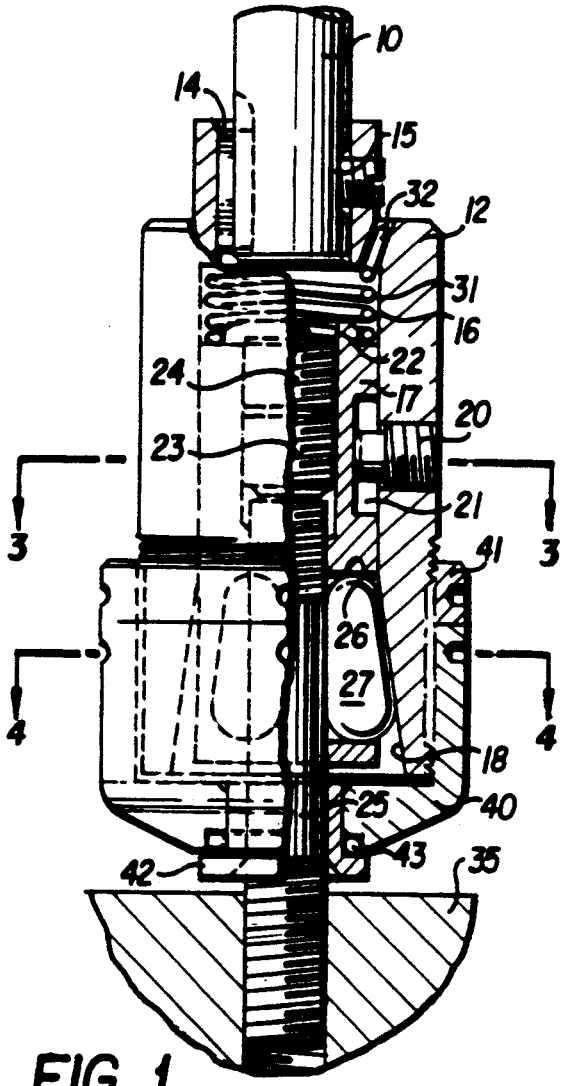
FIG. 1
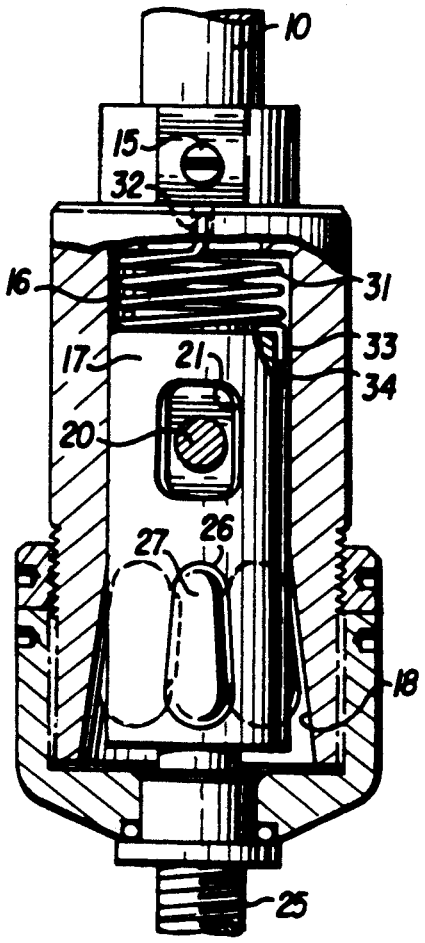
FIG. 2
FIG. 3
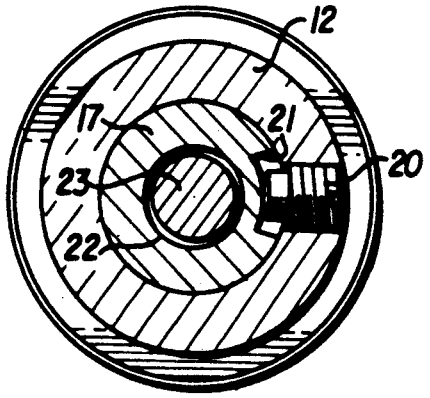
FIG. 4
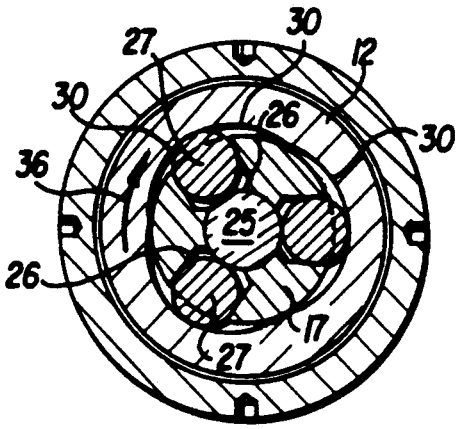

STUD DRIVER AND REMOVER FOR LARGE DIAMETER STUDS

BACKGROUND OF THE INVENTION

1. Field of the Invention

The present invention relates to a stud driver and remover for large diameter studs. In particular, the present invention relates to a stud driver and remover for large diameter studs in which the stud driver and remover has an improved construction over the prior art that enables the inventive stud driver and remover to quickly remove large diameter studs that previously had to be removed by drilling the stud out of the workpiece.

2. Description of Related Art

Stud drivers and removers for small diameter studs are known. For example, Kirkland U.S. Pat. No. 2,069,527 discloses a chuck adapted for stud driving and removing in which three relatively small rolls rotatably grasp the stud. In addition, the assignee of the present application has sold a stud driver and remover under the trademark ROLL-GRIP for small diameter studs, i.e., studs having a diameter between three sixteenths of an inch and three inches. These stud drivers and removers have worked very well for the small diameter studs, but are not readily adaptable simply by increasing their size to accommodate removal or driving of large diameter studs, i.e., studs having a diameter of greater than $\frac{3}{4}$ inches, due to the larger stud diameters and increase in torque necessary to remove or drive such large diameter studs.

Large diameter studs are used in many industries, such as chemical plants, electrical generators and nuclear facilities. In these industries, it is often required to remove the studs for periodic inspections and/or maintenance. These industrial sites may have between 100–200 or more studs on site. In the past, there were no tools which readily removed the studs. If a tool was available, the tool would either deform the stud during the removal process, thereby rendering the tool incapable of grasping the stud to complete the removal process; or the tool could not withstand the high torque necessary for large diameter stud removal, thereby resulting in a breakdown of the tool. As a consequence, large diameter studs were often drilled out, which required 2–3 hours per stud.

SUMMARY OF THE INVENTION

The present invention is directed to a stud driver and remover which overcomes the problems of the prior art and accommodates driving and removing of large diameter studs. The stud driver and remover in accordance with the present invention can remove large diameter studs in about three minutes, thereby significantly reducing the costs of site inspections and maintenance in industries using large diameter studs. The stud driver and remover in accordance with the present invention also is capable of accepting an increased stud size variance, thereby decreasing the number of tools necessary to cover every conceivable stud size, which in turn decreases inventory and saves costs.

In accordance with the present invention, a tool driven by a driving adaptor for driving and removing a stud relative to a workpiece, comprises:

a main ring with an axial bore, one end of the bore being located adjacent the driving adaptor and the opposite end having an outwardly tapering section;

a core member mounted within the bore for limited axial and rotary movement relative to the main ring;

a plurality of tapered rolls carried by the core member and cooperating with the outwardly tapering section of the bore for frictionally engaging the stud upon axial movement of the core toward the one end of the bore and for releasing the stud upon axial movement of the core toward the opposite end of the bore; and the outwardly tapering section of the bore including an axially extending cam surface for each roll for locking the main ring and the stud upon rotation of the core member relative to the main ring, wherein the plurality of rolls includes no less than five rolls equally radially spaced about the core;

a ratio of a cross-sectional area of the stud to a cross-sectional area of one roll is about 5 to 1; and a cross-sectional area of an amount of material displaced by the plurality of rolls is no less than a cross-sectional area of the stud.

BRIEF DESCRIPTION OF THE DRAWINGS

A preferred embodiment of the present invention will be described in detail in the following description, taken in conjunction with the following drawings in which like elements are denoted with like reference numerals, and wherein:

FIG. 1 is a side elevation, with parts being broken away and shown in sections, of a prior art stud driver and remover;

FIG. 2 is a similar view of the mechanism shown in FIG. 1, the FIG. 2 view being taken at an angle of 90° with reference to the view of FIG. 1;

FIGS. 3 and 4 are sections taken along the lines 3—3 and 4—4 of FIG. 1;

DETAILED DESCRIPTION OF THE PREFERRED EMBODIMENT

Figure 5:
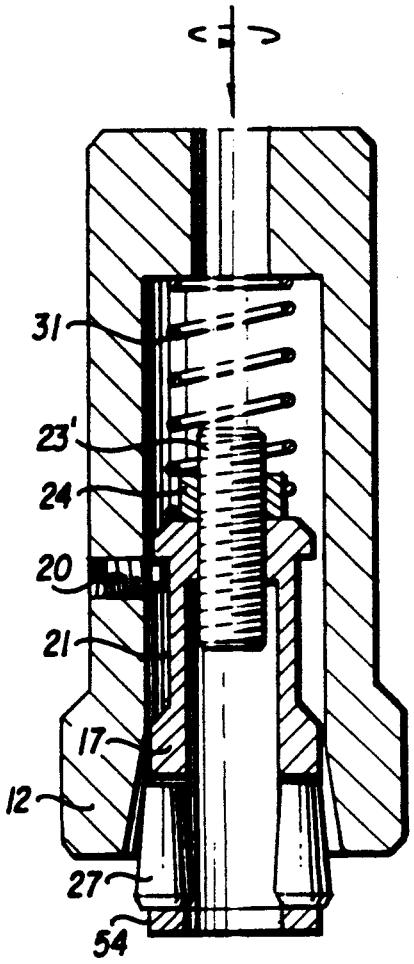
FIG. 5 is a schematic cross-sectional view showing the major components of the Titan Tool ROLL-GRIP TM stud driver and remover with the rolls disengaged from the main ring.

The invention will be described in detail with reference to the stud driver and remover described in Kirkland U.S. Pat. No. 2,069,527, the disclosure of which is hereby incorporated by reference. Further, the invention will be described with reference to the Titan Tool ROLL-GRIP TM stud driver and remover, which is described in Titan Tool Company's 1982 ROLL-GRIP brochure, the disclosure of which is hereby incorporated by reference.

The general structure and operation of the stud driver and remover corresponds to the prior art illustrated in FIGS. 1-6. A driving adapter 10 is non-rotatably connected to the main ring 12 of the stud driver and remover. The driving adapter 10 and the main ring 12 may be connected together by any appropriate means, such as the slot and key connection 14 or the set screw and flat connection 15. The main ring is provided with an axial bore 16 in which a core member 17 is reciprocally mounted. The open end of the bore 16 includes an outward taper 18. The main ring 12 and the core member 17 are preferably of cylindrical formation and are connected by means of a screw 20 and a slot 21, thereby permitting relative axial and rotary movements between the driving and core members. The slot 21 and screw 20 limit both the axial and rotary movements of the driving and core members relative to each other. The core member 17 is provided with a threaded axial bore 22 in which are mounted screw plugs 23, 24, the plug 23 serving as an adjustable stop adapted to engage the end of a stud 25 and the plug 24 serving to lock the plug 23 in its adjusted position within the core member 17.

Figure 6:
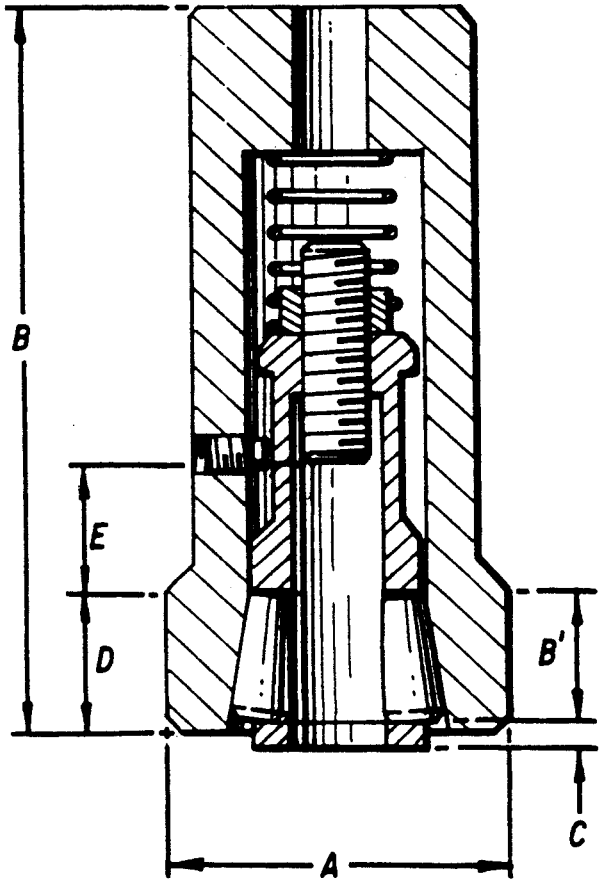
FIG. 6 is a schematic cross-sectional view showing the main components of the Titan Tool ROLL-GRIP TM with the rolls engaged in the main ring.

In the ROLL-GRIP TM stud driver and remover illustrated in FIGS. 5-6, the screw plugs 23, 24 are replaced by a core adjusting screw 23' and a lock nut 24'. The position of the core adjusting screw 23' is adjustable to set the depth to which the stud can enter the tool. The lock nut 24' locks the core adjusting screw 23' in its adjusted position. Also, in contrast to the prior art inventions, FIG. 5 illustrates that the drive square is located integrally in main ring 12.

In the prior art, the outer end of the core member 17 was provided with three axially directed slots 26 in which rolls 27 were disposed. The rolls 27 were tapered from end to end so as to contact over substantially their full length with the tapered, outwardly flared surface 18 of the main ring 12. As illustrated in FIG. 4, the outwardly flared portion 18 of the main ring 12 has cam surfaces 30 formed thereon which diverge radially outwardly at the central portion of each cam surface.

In operation, when the stud driver and remover is lowered over stud 25 with the upper end of the stud abutting the adjustable stop plug 23 or core adjusting screw 23', the core member 17 is elevated to bring the rolls 27 into contact with the cam surfaces 30. The cam surfaces 30 on the main ring 12 curve radially inwardly with reference to the rolls 27 when the rolls 27 are centrally positioned with respect to the cam surfaces, so that movement of the main ring in a rotary direction either to the right or to the left relative to the roll 27 will move these rolls inwardly against the stud 25.

A helical spring 31 is disposed between the main ring 12 and the upper end of the core member 17. Preferably, one end 32 of the spring 31 is located in a suitable opening in the main ring 12 while the other end 33 of the spring is located in a suitable opening 34 in the core member 17. The spring 31 is compressed when assembled in position so that it normally urges the core member 17 outwardly relative to the main ring 12 so that the screw stop 20 is normally disposed in the upper end of the slot 21 when the chuck is not engaged on a stud.

To insert a stud, the tool is placed over the stud with the upper end of the stud abutting against the adjustable stop plug 23 or core adjusting screw 23' to elevate the core member 17 together with the rollers 27 until the rolls contact the cam surfaces 30 of the outwardly flared bore 18. The spring 31 has up to this time maintained the core member 17 and the rollers 27 in a lowered position with respect to the main ring 12 so that the rollers were out of contact with the cam surfaces 30 and free to move radially outwardly so that they would not exert any frictional gripping action upon the stud 25. However, as the upper end of the stud 25 causes elevation of the plug 23 (or core adjusting screw 23') and the core member 17, the rolls 27 are brought into contact with the cam surfaces 30 to cause initial frictional engagement therebetween. Since the main ring is being rotated in a clockwise direction as indicated by the arrow 36 in FIG. 4, the rolls 27 will be rotated in a corresponding direction and wedged between the cam surfaces 30 and the stud 25 so as to frictionally lock the main ring 12 to the stud and rotatably drive the stud into the work piece 35.

Continued rotation of the tool in the direction indicated rotatably threads the stud 25 into the workpiece 35 until the main ring 12 (or a part fixed against relative axial movement to the main ring 12) contacts the upper surface of the workpiece 35. Upon contact, the stud 25 continues to be threaded into the workpiece 35 for a slight distance thus lowering the stud relative to the main ring 12 for a slight distance to affect a release of the pressure exerted by the stud 25 on the adjustable plug 23 (or core adjusting screw 23') thus permitting the core member 17 to be lowered slightly with reference to the driving member by the expansion of spring 31. This releases the frictional gripping action of the rolls 27 upon the stud 25 so that the tool may be elevated and removed from the stud.

The tool is adjusted by turning the plug 23 or core adjusting screw 23' downwardly and locking it in position by means of the locking plug 24 or lock nut 24'. The driving adapter 10 is rotated in the reverse direction with the tool being lowered over the stud so that the upper end of the stud contacts the abutment plug 23 or core adjusting screw 23' to elevate the core member 17 relative to the main ring 12 and to bring the rolls 27 into contact with the tapered bore 18. Rotation of the driving adapter 10 in the counterclockwise direction as viewed in FIG. 4, wedges the rolls 27 between the relatively stationary stud 25 and the oppositely sloping portions of the cam surfaces 30 so as to frictionally lock the stud with reference to the driving adapter 10. When the stud has been turned out of the workpiece 35, it is released from the tool by pulling it downwardly with reference to the main ring 12.

FIG. 5 illustrates a schematic cross-sectional view of the Tital Tool ROLL-GRIP TM with the rolls 27 disengaged from the main ring 12. FIG. 6 illustrates the Tital Tool ROLL-GRIP TM with the rolls engaged in the main ring in the position in which the rolls would grasp a stud (not shown in FIGS. 5-6). Readily available commercial versions of the ROLL-GRIP TM are available for stud diameters up to three inches, and larger sizes are available upon request. For a three inch diameter stud, the tool has an outside diameter A of 5.0 inches, a length B of 12 7/32 inches, and a weight of 34.6 pounds. The length B' of the rolls 27 is 0.845 inches including the tapers "t" at each end of the roll (see FIG. 7). If the tapers "t" are ignored, the roll length is 13/16 inches. The core cap width C is 0.25 inches. The minimum grip D to the top of the rolls 27 is 1 1/16 inches and the maximum area E above the rolls is 6⅛ inches.

Figure 7:
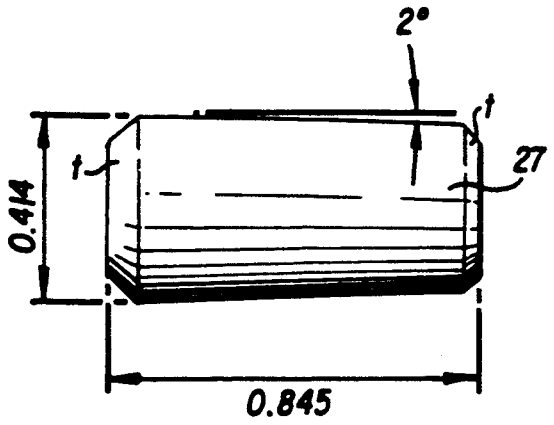
FIG. 7 is a side view of a prior art roll.
Figure 8:
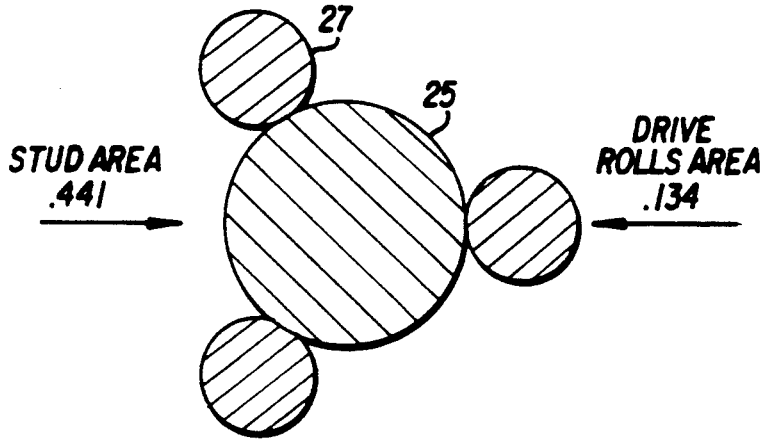
FIG. 8 is a cross-sectional view of the relationship of the cross-sectional area of a stud to a cross-sectional area of a roll.
Figure 9:
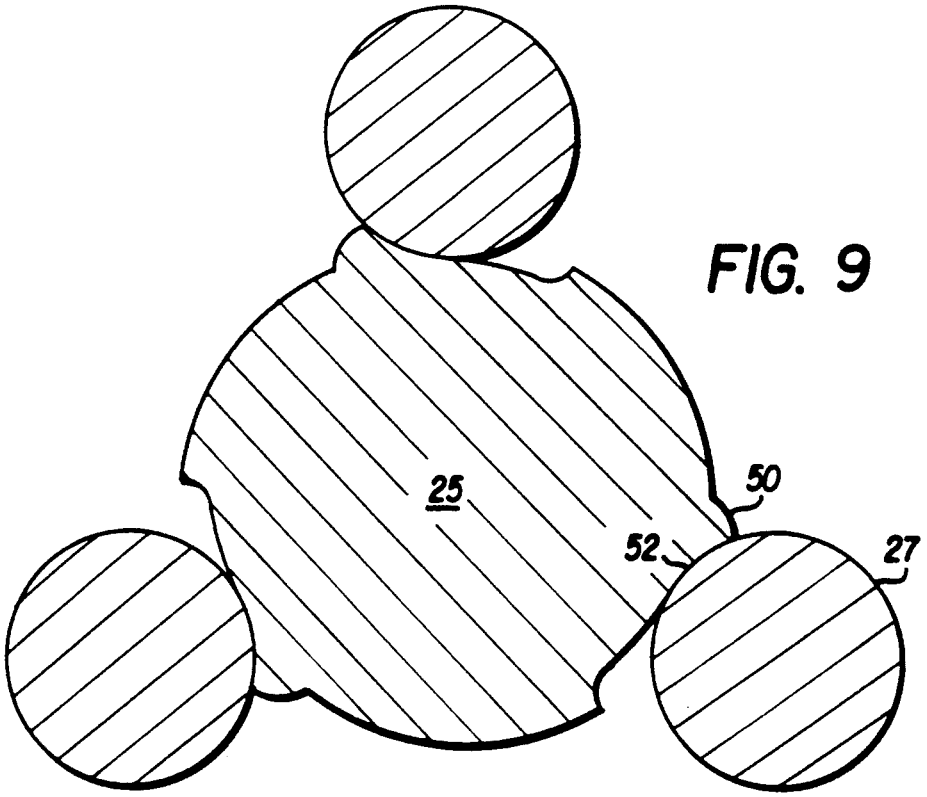
FIG. 9 is a cross-sectional view showing the displacement of material in the stud by the rolls.

The prior art roll 27 is illustrated in FIG. 7 in which the roll 27 has a relatively short length of 0.845 inches, a relatively small diameter of 0.414 inches and an included angle of 4° (2° on each side). The length to diameter ratio of small rolls is about 2.0. For smaller stud sizes, there is a ratio of about 3 to 1 between the cross-sectional area of the stud 25 and the cross-sectional area of one drive roll 27. For example, as illustrated in FIG. 8, the stud 25 has an area of 0.441 $in^2$ and each drive roll 27 has a total cross-sectional area of 0.134 $in^2$ at its largest diameter. This relationship was important in stud drivers and removers for small diameter studs because, as illustrated in FIG. 9, as the torque increases, the drive roll 27 starts to penetrate the surface of the stud 25 thus displacing a small amount of material. This material forms a wave 50 in front of the roll 27 and provides a contact surface 52 on which the roll 27 can transmit torque to the stud 25. If this displacement does not occur so that the wave 50 is not formed, or if the wave is insufficient in size, the stud driver and remover will start to slip as the applied torque increases since there is no contact surface on which the roller can transmit torque to the stud.

Figure 10:
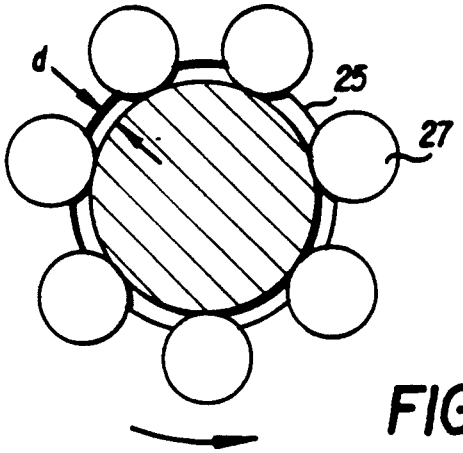
FIG. 10 is a cross-sectional view showing a necked down stud in which the rolls are unable to grasp the stud.

As the diameter of the studs increase, the ratio between the cross-sectional area of one roll 27 and the stud 25 becomes insufficient to provide an adequate grip. One conventional solution was to increase the number of drive rolls in each tool, with smaller tools using three rolls and larger tools using up to eleven rolls. This solution was not adequate because the increase in the number of rolls requires a decrease in the angle between the rolls. The decrease in angle between the rolls increases the potential for the roll 27 to "neck down" the diameter of the stud 25 to a size that it will no longer be capable of securely gripping the stud. FIG. 10 illustrates the situation with 7 rolls 27 where each roll is unable to form a wave and create sufficient contact area to grip the stud. In particular, if the number of rolls increases so that the angle between the rolls decreases, when each roll 27 penetrates the stud 25 to a depth "d," there will be insufficient room between the rolls 27 for each stud to form a wave to create its contact area. As a result, the contact area of one roll merges into the contact area of an adjacent roll to neck down the stud so that none of the rolls form a wave or sufficient contact area to grasp the stud.

Figure 11:
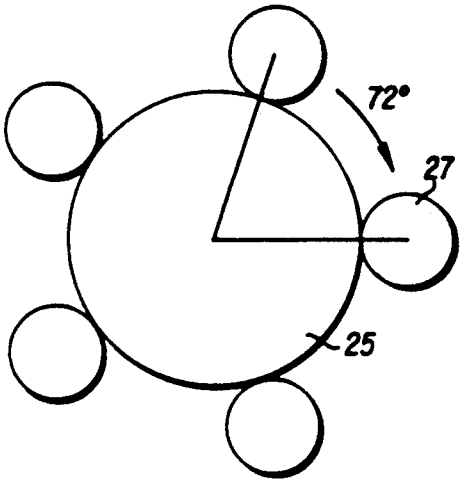
FIG. 11 is a cross-sectional view of five rolls acting on one stud.

In accordance with one aspect of the invention, experiments by the inventor have shown that the optimum number of rolls for stud sizes in excess of 1.25 inches in diameter is five rolls as illustrated in FIG. 11. The use of five rolls places the rolls 72° apart which is adequate to prevent the stud from being necked down.

While it is desirable to maintain the 3 to 1 ratio between the cross-sectional area of the stud and the drive roll for small studs, that ratio is unreasonable for larger studs. For example, if this ratio were rigidly applied, a tool for use on six inch diameter studs would require a roll diameter of 1.732 inches, thereby rendering the tool prohibitively large for most applications. Therefore, in accordance with another aspect of the invention, with the number of rolls being five in accordance with the first aspect of the invention, tools for large diameter studs include a cross-sectional area ratio of five to one. This increased ratio increases the contact area and allows the roll to penetrate deeper into the stud thereby obtaining a more secure grip and readily removing the large diameter stud.

The inventors have also determined that the removal of large diameter studs is obtained when the amount of material displaced by the five rolls (equal to five times the cross-sectional area of the wave 50 in FIG. 9) is equal to or greater than the cross-sectional area of the stud. By satisfying this criteria, in addition to the use of 5 rolls and maintaining the 5 to 1 cross-sectional area ratio, tools have been produced which are capable of grasping large diameter studs and applying sufficient torque to the stud to rotatably remove the stud from the workpiece.

Other factors can also be varied to increase the gripping ability of the rolls, such as increasing the overall length of the roll, decreasing the included angle, and improving the cooperation between the cam and the core, thereby allowing the roll to penetrate deeper into the stud. More specifically, the roll must have the ability to displace a sufficient amount of material to insure proper gripping strength. Increasing the overall length of the roll allows more length of the stud to be grasped and improving the cooperation between the cam and the core allows deeper penetration into the stud thereby increasing the amount of material displaced and insuring a proper grip.

Further, changing the included angle of the roll inhibits "cam out". For example, as torque is applied to the tool, the force is transmitted to the roll 27 and the majority of this force is then transmitted to the stud 25. A small portion of the force is expended in trying to force the roll 27 to walk out of the cam 30, which is an unloading action known as "cam out". The larger the included angle of the roll, the greater the tendency to cam out. While the cam out action can be overcome by exerting an opposing force on the main ring 12, it is often impossible for the operator to exert such an equal and opposite force on the main ring as the torque increases.

To eliminate the cam out problem, it is possible to eliminate the included angle of the rolls. However, this solution is unsatisfactory because as the angle approaches 0°, the tendency is for the rolls to jam against the cam and inhibit the relatively easy removal of the tool at the completion of its cycle. It has therefore been determined that an optimum included angle is 2° which provides sufficient resistance to cam out while still allowing easy removal of the tool from the stud.

Figure 12A:
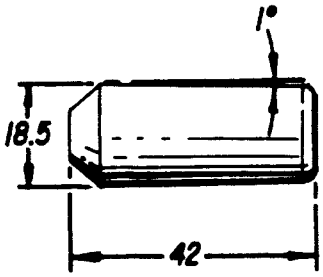
FIGS. 12A and 12B are side views of two rolls used in the tool in accordance with the present invention.
Figure 12B:
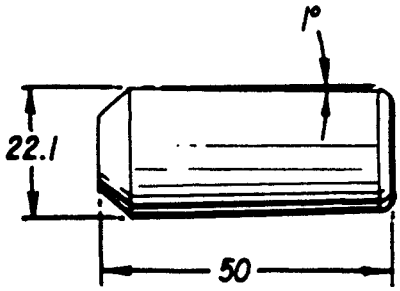

FIGS. 12A and 12B illustrate two inventive drive rolls for removing large diameter studs. The drive roll of FIG. 12A has a length of 42 mm and diameter of 18.5 mm, while the FIG. 12B drive roll has a length of 50 mm and diameter of 22.1 mm. The rolls have increased length and diameter over the prior art rolls for small diameter studs because the ratio of roll length to diameter is increased to 2.25 in the inventive rolls. Further, the included angle is set at 2° (1° on each side) to resist cam out while still allowing easy removal of the tool from the stud.

Figure 13:
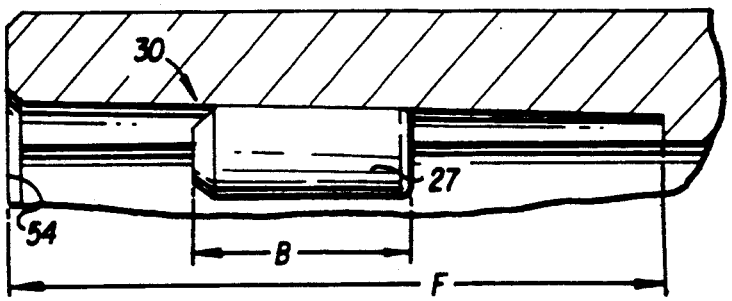
FIG. 13 is a cross-sectional view of a core showing a cam and roll for the tool of the present invention.

The increase in diameter of the rolls permits the core and main ring to be modified to be able to accept a much broader variance in stud size than that which was previously available with smaller diameter rolls. For example, in the past, each tool size could accept a total variance of ±0.031 inches. The improved stud driver and remover of the present invention accepts a total variance of ±0.075 inches, which is made possible by the increase in play of the increased diameter roll between the cam and the core, and a longer cam 30 which allows full roll contact throughout the range of the tool, as illustrated in FIG. 13. The cam 30 is also shallower since its angle will be set at 2° to match the included angle of the roll.

Further, the cam length F in the axial direction of the tool is increased. This permits the tool to compensate for undersized and oversized studs. Since the roll can move along the cam to either axial end position of the cam, the tool can accept a wider variance in stud diameter, the smaller studs moving the roll up the cam toward the driving adapter (to the right in FIG. 13), and the larger studs moving the roll down the cam toward the core cap 54 (to the left in FIG. 13). In the prior art stud driver and remover, the ratio of cam length F to roll length B was about 1.5 to 1, while in the present invention the ratio of cam length F to roll length B is increased to about 2.5 to 1.

These alterations permit each tool to accept a stud variance of 0.15 inches, thereby permitting tools to be produced in 1.25 increments instead of the current 0.063 inch increments. This means that only forty different tools would be needed to cover every conceivable stud size between one and four inches as opposed to eighty sizes using prior art designs. This change reduces inventory, improves the ability to deliver tools in a timely fashion, and saves customers money since customers do not have to purchase as many sizes to cover their needs.

Another aspect of the invention is directed towards the use of impact tools and their affect on prior art stud drivers and removers. When impact tools are used to power prior art stud drivers and removers, shock waves are sent from the drive tool through the main ring, the shock being transmitted to the rolls and the rolls tending to transmit the shock to the stud in the core. In the past, the shock wave tends to break the core cap 54 from the core 17. Once the core cap 54 is broken, the rolls fall free from the tool thus disabling the tool. To overcome this problem, it has been suggested to use a two piece core in which the core cap was brazed or welded in place. Neither the brazed nor welded caps provided sufficient increased strength. Set screws were therefore provided to secure the brazed cap to the core by locating the set screws in the lands between the openings for the rolls. While this cap proved to be more durable, the caps were still subject to premature failure when used on impact tools. One piece cores have been produced in the prior art, but these one piece cores were cast cores which required the pouring of molten metal into a mold to create the core. This process was expensive.

Figure 14:
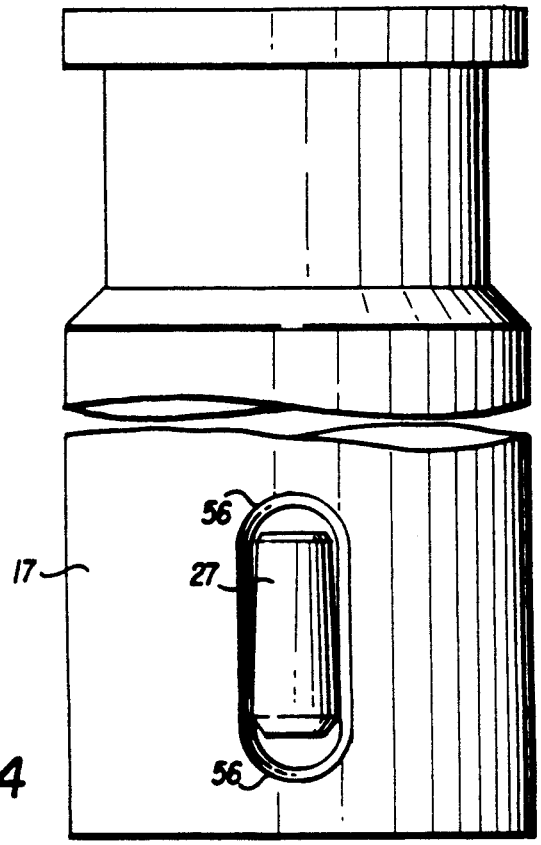
FIG. 14 is a side view of a core having rounded corner slots for the tool in accordance with the present invention.

In accordance with the invention, the core 17 is a one piece core cut from bar stock in which the slots for the rolls are produced with a ball mill to create rounded slots 56 as illustrated in FIG. 14. The slots 56 have an inner diameter 56*a* less than the diameter of the rolls so that the rolls do not fall radially inward into the core The main ring 12 prevents the rolls from falling racdially outwardly from the tool. The use of the one piece core with the ball mill produced slots produces a core with strong rounded corners that are more capable of absorbing and distributing the shock waves created by impact drivers. In particular, the shock wave dissipates better in the rounded corner core because there are no straight angled corners in which the stress concentrates. The core member 17 is also easier, cheaper and faster to produce.

The invention has been described above in detail with reference to its preferred embodiments, which are intended to be illustrative and non limiting. Various changes and modifications may be made without departing from the spirit and scope of the invention as defined in the following claims.

What is claimed is:

1. A tool driven by a driving adaptor for driving and removing a stud relative to a workpiece, the stud having a longitudinal axis and a diameter measured in a transverse direction perpendicular to the longitudinal axis of the stud, the tool comprising:

a main ring with an axial bore, one end of the bore being located adjacent the driving adaptor and the opposite end having an outwardly tapering section;

a core member mounted within the bore for limited axial and rotary movement relative to the main ring;

a plurality of tapered rolls each having a longitudinal axis and being carried by the core member, each of said plurality of rolls cooperating with the outwardly tapering section of the bore for frictionally engaging the stud upon axial movement of the core toward the one end of the bore and for releasing the stud upon axial movement of the core toward the opposite end of the bore; and the outwardly tapering section of the bore includes an axially extending cam surface for each roll for locking the main ring and the stud upon rotation of the core member relative to the main ring; wherein the plurality of rolls includes no less than five rolls equally radially spaced about the core;

each of said rolls having a diameter measured in a transverse direction perpendicular to the longitudinal axis of each roll that results in a ratio between a cross-sectional area of the stud taken in the transverse direction of the stud and a cross sectional area of one roll taken in the transverse direction of said one roll being equal to about 5 to 1.

2. The tool of claim 1, wherein a ratio of a length of the cam surface to a length of a corresponding roll is about 2.5 to 1.

3. The tool of claim 1, wherein a ratio of a length of each roll to a diameter of each roll is about 2.25 to 1.

4. The tool of claim 1, wherein the plurality of rolls includes only five rolls.

5. The tool of claim 1, wherein said plurality of rolls are equally spaced on said core member.

6. The tool of claim 1, wherein said plurality of rolls are spaced apart from each other by an angle of about 72 degrees.

7. The tool of claim 1, wherein said stud driver and remover is formed so as to be operative to drive and remove studs having a total variance in stud diameter of about plus or minus 0.075 inches.

8. The tool of claim 1, wherein each of said rolls has a total included angle of about 2 degrees, the total included angle being formed by an included angle of about 1 degree on each side of each of the rolls.

9. The tool of claim 1, wherein each axially extending cam has an included angle of about 2 degrees to match an included angle of each of said plurality of rolls.

10. A tool driven by a driving adaptor for driving and removing a stud relative to a workpiece, the stud having a longitudinal axis and a diameter measured in a transverse direction perpendicular to the longitudinal axis of the stud, the tool comprising:

a main ring with an axial bore, one end of the bore being located adjacent the driving adaptor and the opposite end having an outwardly tapering section;

a core member mounted within the bore for limited axial and rotary movement relative to the main ring;

a plurality of tapered rolls each having a longitudinal axis and a diameter measured in a transverse direction perpendicular to the longitudinal axis of each roll, carried by the core member and cooperating with the outwardly tapering section of the bore for frictionally engaging the stud upon axial movement of the core toward the one end of the bore and for releasing the stud upon axial movement of the core toward the opposite end of the bore; and the outwardly tapering section of the bore includes an axially extending cam surface for each roll for locking the main ring and the stud upon rotation of the core member relative to the main ring; wherein the plurality of rolls includes no less than five rolls equally radially spaced about the core;

each of said plurality of rolls grip the stud by penetrating the circumference of the stud thereby displacing a small amount of material from the stud circumference; and each of said plurality of rolls is formed such that a cross-sectional area taken in the transverse direction of each roll of a total amount of material displaced by the plurality of rolls is no less than a cross-sectional area of the stud taken in the transverse direction of the stud.

11. The tool of claim 10, wherein a ratio of a length of the cam surface to a length of a corresponding roll is about 2.5 to 1.

12. The tool of claim 10, wherein a ratio of a length of each roll to a diameter of each roll is about 2.25 to 1.

13. The tool of claim 10, wherein the plurality of rolls includes only five rolls.

14. The tool of claim 10, wherein said plurality of rolls are equally spaced on said core member.

15. The tool of claim 10, wherein said plurality of rolls are spaced apart from each other by an angle of about 72 degrees.

16. The tool of claim 10, wherein said stud driver and remover is formed so as to be operative to drive and remove studs having a total variance in stud diameter of about plus or minus 0.075 inches.

17. The tool of claim 10, wherein each of said rolls has a total included angle of about 2 degrees, the total included angle being formed by an included angle of about 1 degree on each side of each of the rolls.

18. The tool of claim 10, wherein each axially extending cam has an included angle of about 2 degrees to match an included angle of each of said plurality of rolls.

* * * * *